US005426878A

United States Patent [19]

Branson

[11] Patent Number: 5,426,878

[45] Date of Patent: Jun. 27, 1995

[54] DUAL MOTION LIQUID-FILLED AMUSEMENT DEVICE

[76] Inventor: Todd L. Branson, 810 - 6th St. S. Apt. #1, Hopkins, Minn. 55343

[21] Appl. No.: 252,909

[22] Filed: Jun. 2, 1994

[51] Int. Cl.[6] ..... G09F 19/00

[52] U.S. Cl. ..... 40/409; 40/439; 40/477

[58] Field of Search ..... 40/409, 439, 477; 446/267, 489

[56] References Cited

U.S. PATENT DOCUMENTS

| | | | |
|---|---|---|---|
| 1,664,444 | 5/1928 | Borchert | 40/409 X |
| 1,797,508 | 3/1931 | Lawrence | 40/409 |
| 2,361,346 | 10/1944 | Atkins | 40/409 |
| 4,032,141 | 6/1977 | Tanimura . | |
| 4,049,277 | 9/1977 | Carlsson et al. . | |
| 4,643,693 | 2/1987 | Rubinstein . | |
| 5,017,171 | 5/1991 | Shiina . | |
| 5,228,225 | 7/1993 | Lee . | |

FOREIGN PATENT DOCUMENTS

| | | | |
|---|---|---|---|
| 1338326 | 8/1963 | France | 40/409 |

*Primary Examiner*—Kenneth J. Dorner
*Assistant Examiner*—Cassandra Davis

[57] ABSTRACT

An amusement device which includes a transparent tank filled with a liquid medium such as water. Contained within the tank is a plurality of uniform diameter, positive and negative buoyant spheres. Disposed inside the tank is a downward directional tubal system and an upward directional tubal system which are used to move the spheres in opposite directions of their buoyancies. Located beneath the floor of the tank is an air pump which feeds air into the tubal systems to create currents which forcibly move the spheres through the tubes. Also disposed in the tank are downward and upward directional tracks which route the spheres to their respective staging areas, depending upon their buoyancies. For example, positive buoyant spheres travel upward in the liquid medium along the underside of the upward directional track while the negative buoyant spheres travel downward in the liquid medium along the top side of the downward directional track. The positive buoyant spheres move through the downward directional tubal system and then along the bottom surface of the track to a staging area. From there, they are again drawn into the downward directional tubal system and the cycle repeats. The negative buoyant spheres travel in the opposite direction.

20 Claims, 8 Drawing Sheets

DUAL MOTION LIQUID-FILLED AMUSEMENT DEVICE

BACKGROUND OF THE INVENTION

1. Field of the Invention

The present invention relates to amusement devices and, more particularly, to amusement devices filled with a liquid medium that have objects that move in an intriguing manner therein.

2. Description of the Related Art

There are many amusement devices available today which contain a liquid medium and have objects or material which are moved or dispersed therein for entertainment purposes. Movement of the objects or the material in the liquid medium is usually predictable and constant and has a soothing effect on an observer. Typically, the objects or material have uniform buoyancies so that they move in the liquid medium in one direction when the device's outer container is tilted, inverted, or shaken.

SUMMARY OF THE INVENTION

It is an object of the present invention to provide an attractive amusement device that is filled with a liquid medium.

It is another object of the present invention to provide such a device that contains objects that move continuously in the liquid medium.

It is a further object of the present invention to provide such a device in which the objects move in an unpredictable, yet intriguing, manner.

These and other objects are met by the described invention which includes a container with an upper closed tank structure filled with a liquid medium. In one embodiment, the container is triangular-shaped with three vertically aligned, planar, lateral faces. Located at approximately ¼ the height of the container is a sloped platform which forms the floor of the upper tank. Located below is a lower compartment which houses an air pump and an optional light. The lateral faces and the floor of the tank are made of clear or colored transparent material so that movement of the liquid medium and the various objects and air bubbles in the liquid medium may be observed. The liquid medium itself may be clear or colored water or some other suitable liquid.

Dispersed in the liquid medium are a plurality of spherical uniform-shaped objects which appear to move in an intriguing, fascinating manner in the liquid medium. The spherical-shaped objects are manufactured or made of either positive or negative buoyant material. Those spherical-shaped objects which naturally float in the liquid medium are hereinafter known as positive buoyant spheres while those which naturally sink in the liquid medium are hereinafter known as negative buoyant spheres. The positive and negative buoyant spheres may be the same color or different colors.

Located inside the tank are two tubal systems which are used to forcibly deliver the spheres to positions in the liquid medium opposite their natural resting positions therein. One tubal system, hereinafter known as the downward directing tubal system, is used to forcibly deliver the positive buoyant spheres to the floor of the tank. The second tubal system, hereinafter known as the upward directing tubal system, forcibly delivers the negative buoyant spheres to the top surface of the liquid medium. In one embodiment, the downward directing tubal system includes a cluster of three vertically oriented inter-communicating tubes—one long descending tube, one short ascending tube and one short descending tube. The upward directing tubal system includes one long ascending tube. The long ascending and descending tubes in the two tubal systems have sufficient height to extend from the top surface of the liquid medium to the floor of the tank. The long descending tube of the downward directing tubal system has an elliptical top opening located at approximately the top surface of the liquid medium. The long ascending tube of the upward directing tubal system has a bottom opening located near the floor of the tank and a top opening located at approximately the top surface of the liquid medium.

Both the downward and upward directing tubal systems are connected to air sources which deliver air and creates currents therein to move the spheres. In the downward directing tubal system, the first air source is attached to the short ascending tube which creates a downward current of the liquid medium in the long descending tube. During operation, this downward current draws the positive buoyant spheres floating on the top surface of the liquid medium into the top opening of the long descending tube and then downward therethrough. After traveling through the long descending tube, the current forces the positive buoyant spheres upward through the short ascending tube and then downward through the short descending tube from which they are delivered to the floor of the tank. The positive buoyant spheres then gradually float upward to the top surface of the liquid medium following an upward sloped retaining track disposed between the top surface of the liquid medium and the floor of the tank. After floating to the top surface of the liquid medium, the positive buoyant spheres are forced or again drawn by the current in the liquid medium toward the top opening of the long descending tube to repeat the cycle.

The negative buoyant spheres are forcibly delivered to the top surface of the liquid medium via the upward directing tubal system. A second air source delivers air to the long ascending tube thereby creating an upward current therein. During operation, the upward current draws the negative buoyant spheres located on the floor of the tank into the lower opening of the long ascending tube and then upward in the long ascending tube to the top surface of the liquid medium. Once delivered to the top surface of the liquid medium, the negative buoyant spheres sink to the bottom of the tank by following a downward sloped retaining track disposed between the top surface of the liquid medium and the floor the tank. The floor of the tank may be sloped toward the lower opening on the long ascending tube so that negative buoyant spheres migrate to the lower opening when settling to the floor.

In the preferred embodiment, the upward and downward sloped retaining tracks are adjacently aligned so that the downward sloped retaining track is positioned directly over the upward sloped retaining track forming a dual directional track. Also in the preferred embodiment, the second air source is an air hose which delivers air from the top of the short ascending tube located on the downward directing tubal system to the long ascending tube.

During operation, the simultaneous movement of the positive and negative buoyant spheres in the two tubal systems and the retaining tracks appears complex. In most instances, an observer is left wondering why two spheres that appear to be exactly the same size and which are moving in such contradictory manners—one sinks while the other floats; or one shoots up a tube while the other is propelled down a tube; or one moves upward on a retaining track while the other moves downward on a retaining track. While movement of the spheres and air bubbles is intriguing to the observer, it is also soothing in its randomness and belies the fact that there are no visible, mechanical moving parts. An optional light source which illuminates the tank, adds to the display and enables the tank to be enjoyed in a dark room.

DESCRIPTION OF THE PREFERRED EMBODIMENT(S)

Figure 1:
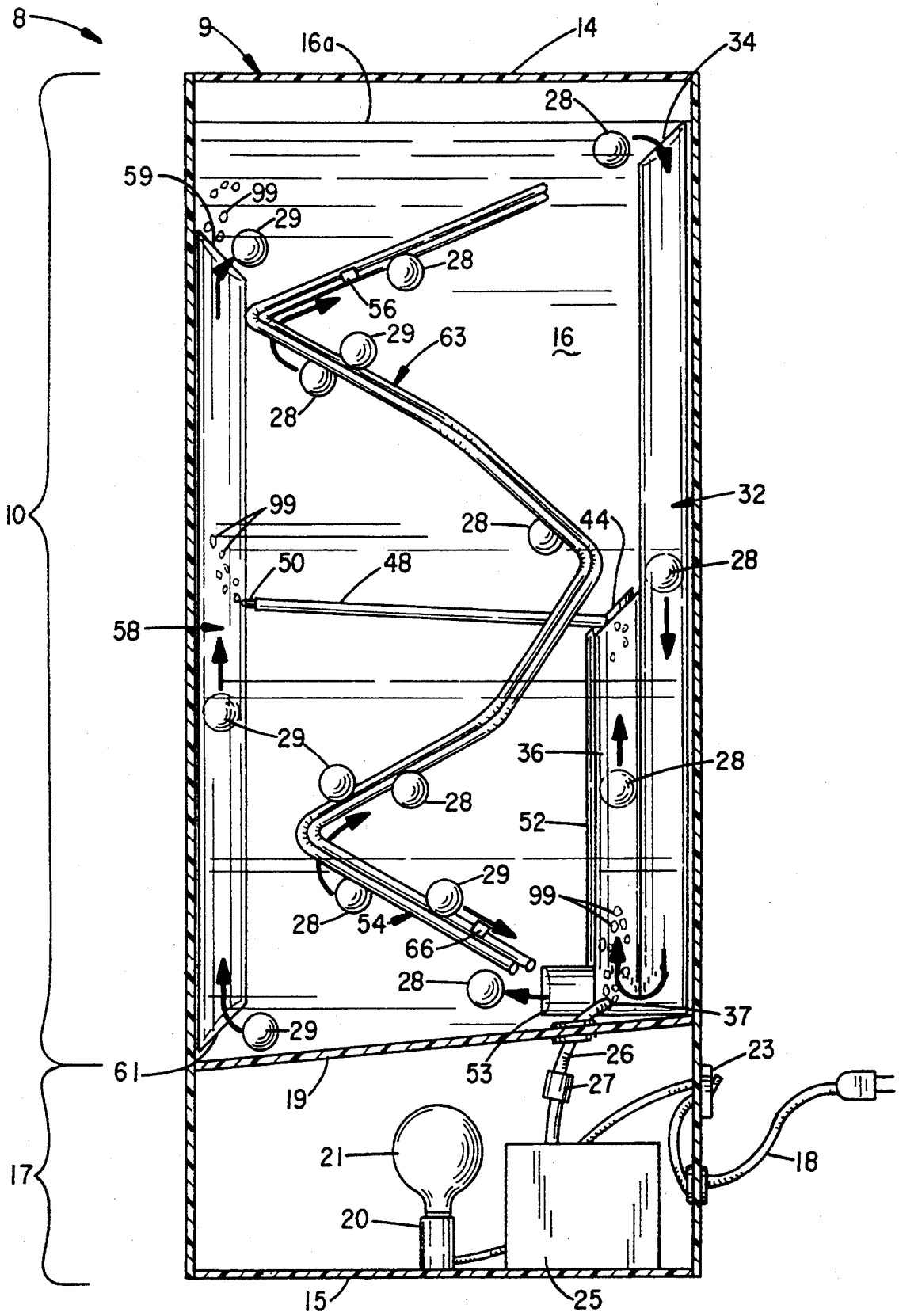
FIG. 1 is a side elevation view of the preferred embodiment of the invention.

FIG. 1 illustrates the preferred embodiment of the present invention. An amusement device 8 comprises a triangular-shaped container 9 with three transparent planar lateral faces 11, 12, and 13, a planar top face 14 and a planar bottom face 15. In the preferred embodiment, the container 9 is divided into an upper, liquid-tight tank 10 and a lower cavity 17 by a sloped platform 19 which forms the floor of the tank 10. The closed cavity 17 houses an air pump 25 and an optional light socket 20 with a light bulb 21 attached thereto. A tube 26 connects the air pump 25 to the inlet port 37 located on the lower portion of the short ascending tube 36. A check valve 27 is disposed along the tube 26 so that the liquid medium 16 does not enter the air pump 25 when the tank 10 is filled with the liquid medium 16. The sloped platform 19 is made of clear or colored transparent material so that light from the light bulb 21 illuminates the tank 10. The light socket 20 is connected to an electrical power cord 18 which plugs into a standard 120 volt AC outlet and is controlled by a light switch 23.

Tank 10 is filled with a suitable liquid medium 16 in which the positive buoyant spheres 28 and negative buoyant spheres 29 are dispersed.

Liquid medium 16 can be clear or colored as long as it is a transparent fluid. The positive buoyant spheres 28 have a specific gravity less than that of the liquid medium 16 thus causing them to float to the top surface 16(*a*) of the liquid medium 16 when dispersed therein. The negative buoyant spheres 29 have a specific gravity greater than that of the liquid medium 16 thus causing them to sink to the sloped platform 19 of the tank 10 when dispersed therein.

Activity within tank 10 is powered by the air 99 pump 25 which pumps air 99 through an air supply tube 26 attached to the inlet port 37. Air 99 flows upward through the short ascending tube 36 and then flows into an air recovery chamber 44 located at the junction of the short ascending tube 36 and the short descending tube 52. The recovery chamber 44 is slanted upward which facilitates continued upward motion of the air 99 and liquid medium 16 contained therein. The air 99 in the recovery chamber 44 exits through a chamber exit port 46 located at the upper portion of the recovery chamber 44. The air 99 is then delivered to the long ascending tube 58 via an air conduit 48 connected at one end to the inlet port 50 located at approximately the mid-point of the long ascending tube 58. The long ascending tube 58 is part of the upward directing tubal system which is used to forcibly deliver the negative buoyant spheres 29 to the top surface 16(*a*) of the liquid medium 16.

Figure 2:
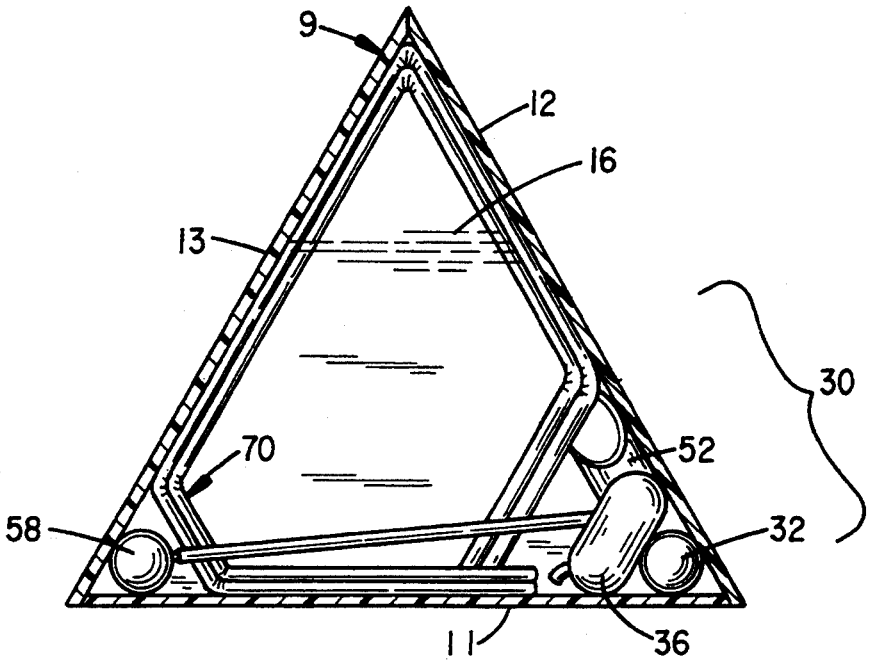
FIG. 2 is a top plan view of the invention shown in FIG. 1.

As shown in FIGS. 1 and 2, the long ascending tube 58 is located in a corner of the tank 10 opposite to the cluster 30 of tubes. Once delivered to the long ascending tube 58, the air 99 continues to move upward therethrough creating an upward current inside the long ascending tube 58. The air 99 is then discharged at the top surface 16(*a*) of liquid medium 16 through the elliptical top opening 59 of the long ascending tube 58.

Figure 3:
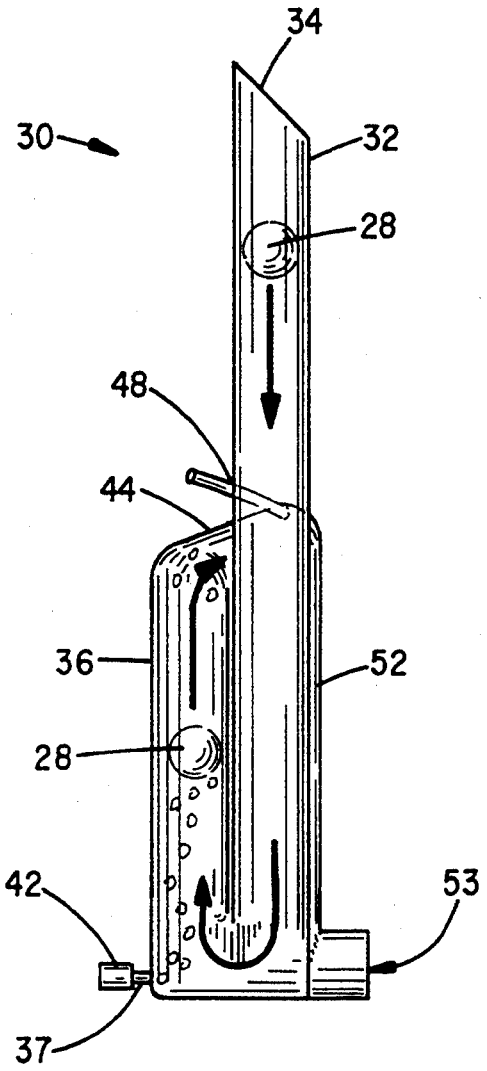
FIG. 3 is a front elevational view of the downward directing tube system.
Figure 4:
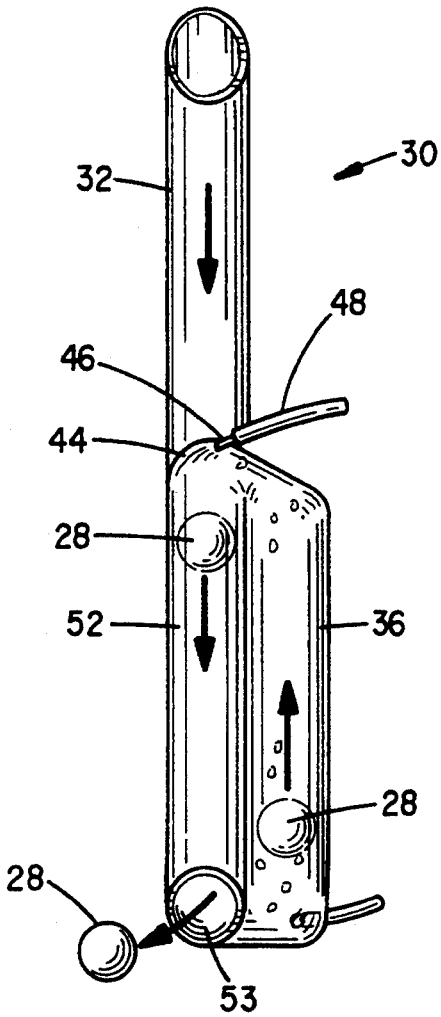
FIG. 4 is a side elevational view of the downward directing tube system shown in FIG. 3.
Figure 5:
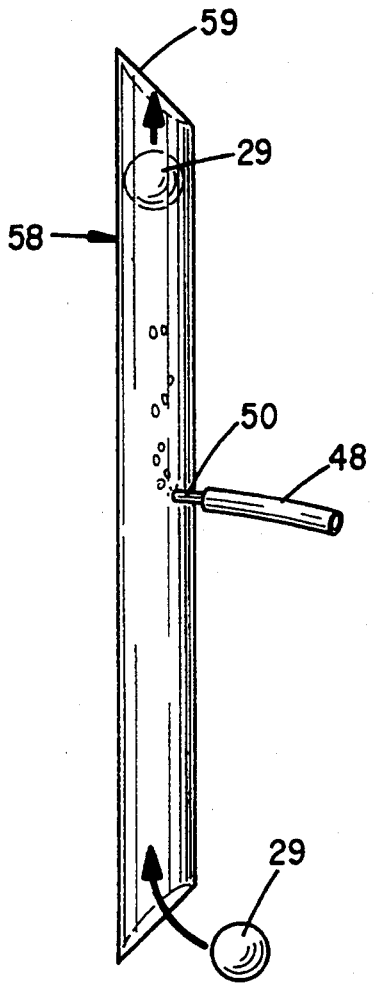
FIG. 5 is a side elevational view of the long ascending tube used in the upward directional tube system.

The downward directing tubal system during operation, forcibly delivers the positive buoyant spheres 28 to the floor of the tank 10. As shown more clearly in FIGS. 3–4, the downward directing tubal system includes a cluster 30 of three vertically aligned tubes; a long descending tube 32, a short ascending tube 36 and a short descending tube 52. The long descending tube 32, short ascending tube 36 and short descending tube 52, are aligned in a side-by-side manner and are interconnected to form a continuous tube structure. The short ascending tube 36 is approximately one-half to one-third the length of the long descending tube 32 in order to create an adequate downward current in the long descending tube 32. In defiance of their natural floating state, the positive buoyant spheres 28 travel through the cluster 30 and are forcibly delivered to the bottom of the tank 10. The long descending tube 32 has an elliptical top opening 34 through which the positive buoyant spheres 28 can enter. The top opening 34 is precisely designed to be slightly larger than the diameter of the positive buoyant spheres 28 surrounded by a small layer of liquid medium 16.

As stated previously, the positive buoyant spheres 28 naturally float to the top surface 16(*a*) of the liquid medium 16. Within the environment of the present invention, the positive buoyant spheres 28 are drawn by the water current into the elliptical top opening 34 of the long descending tube 32 and are then propelled downward. The positive buoyant spheres 28 move through the short ascending tube 36, across the recovery chamber 44 and then downward through the short descending tube 52. The positive buoyant spheres 28 are propelled out of the short descending tube 52 at its exit opening 53. The exit opening 53 is located directly below the lower end of the upward directional track 54 discussed further below. The positive buoyant spheres 28 move upward in the liquid medium 16 by buoyancy forces along the underside of the upward directional track 54. Located on the underside of the upward directional track 54 near the top thereof is an optional delay bump 56 that acts to prevent too many positive buoyant spheres 28 from being delivered to the long descending tube and thereby clogging it. When the positive buoyant spheres 28 pass the delay bump 56, they are then poised to again be on the top surface of the liquid medium 16 and drawn into the top opening 34 of the long descending tube 32 and repeat the entire process.

As stated above, the negative buoyant spheres 29 sink in the liquid medium 16 to the bottom of the tank 10. Within the environment of the present invention, the negative buoyant spheres 29 located on the bottom of the tank 10 are drawn into the elliptical bottom opening 61 on the long ascending tube 58 and are propelled up therethrough. The negative buoyant spheres 29 exit from the long ascending tube 58 through the elliptical top opening 59. The upper end of the downward directional track 63 is positioned just below the top opening 59 so that the negative buoyant spheres 29 sink directly onto the track 63 as they exit the long ascending tube 58. An optional guide rail 60 helps guide the negative buoyant sphere 29 and prevents them from free-falling to the bottom of the tank 10. The negative buoyant spheres 29 move downward by gravity along the top of the downward directional track 63, and are deposited onto the sloped platform 19 on the tank 10. In the preferred embodiment the platform 19 is sloped downward towards the bottom opening 61 of the long ascending tube 58 so that the negative buoyant spheres 29 are directed thereto to repeat the entire process. Located near the bottom of the downward directional track 63 is an optional delay bump 66 that acts to prevent too many negative buoyant spheres 29 from being delivered to the long ascending tube 58.

In the preferred embodiment, the upper directional track 54 and the downward directional track 63 are disposed along the inside surface of the tank 10 at an angle approximately 22 degrees above the horizontal axis. The actual angle used depends upon the relative buoyancies of the positive and negative buoyant spheres 28, 29 in the liquid medium 16 as well as the capacity of the air pump 16.

Figure 6A:
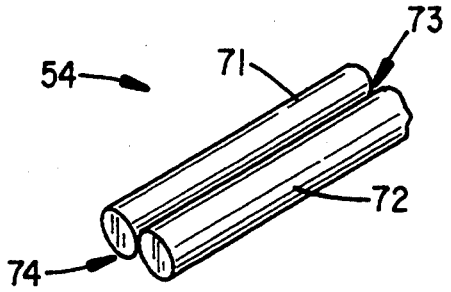
FIG. 6*a* is a perspective view of a portion of side-by-side adjacent round members used to form a dual directional track.
Figure 6B:
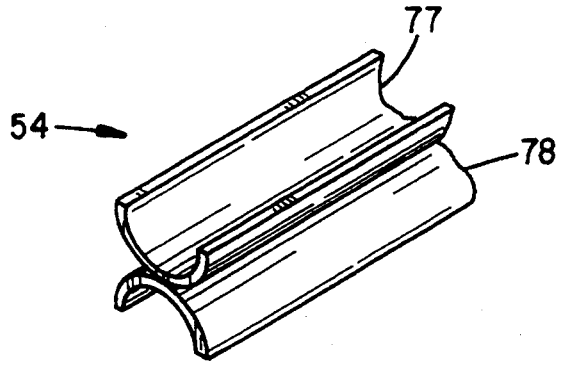
FIG. 6*b* is a perspective view of a portion of two tangentially aligned, stacked, semi-circular members used to form a dual directional track.
Figure 6C:
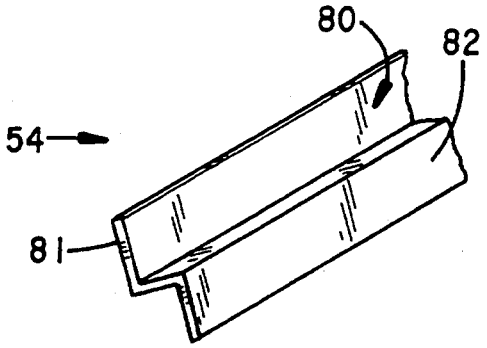
FIG. 6*c* is a perspective view of a portion of a "Z" shaped member used to form a dual directional track.

In FIGS. 1 and 2, the upward and downward directional tracks 54, 63, respectively, are joined together to form a dual directional track structure 70. The dual directional track structure 70 enables the positive and negative spheres 28, 29 to pass each other in opposite directions. FIGS. 6*a–c* disclose several embodiments of the dual directional tracks 70. In FIG. 6*a*, the dual directional track structure 70 includes two side-by-side adjacent round members 71, 72 with upper and lower valleys 73, 74 formed therebetween. In FIG. 6*b*, another embodiment of the dual directional track structure 70 is shown comprising two tangentially aligned, stacked, semi-circular members 77, 78 each capable of retaining the positive and negative buoyant spheres 28 and 29. In FIG. 6*c*, another embodiment of the dual directional track structure 70 is shown comprising a "Z" shaped member 80. The "Z" shaped member 80 has an upper portion 81 and a lower portion 82 capable of retaining the positive and negative buoyant spheres 28 and 29. It should be understood that the upward and downward directional tracks 54, 64 can be separate structures as shown in FIGS. 7 and 8.

Figure 7:
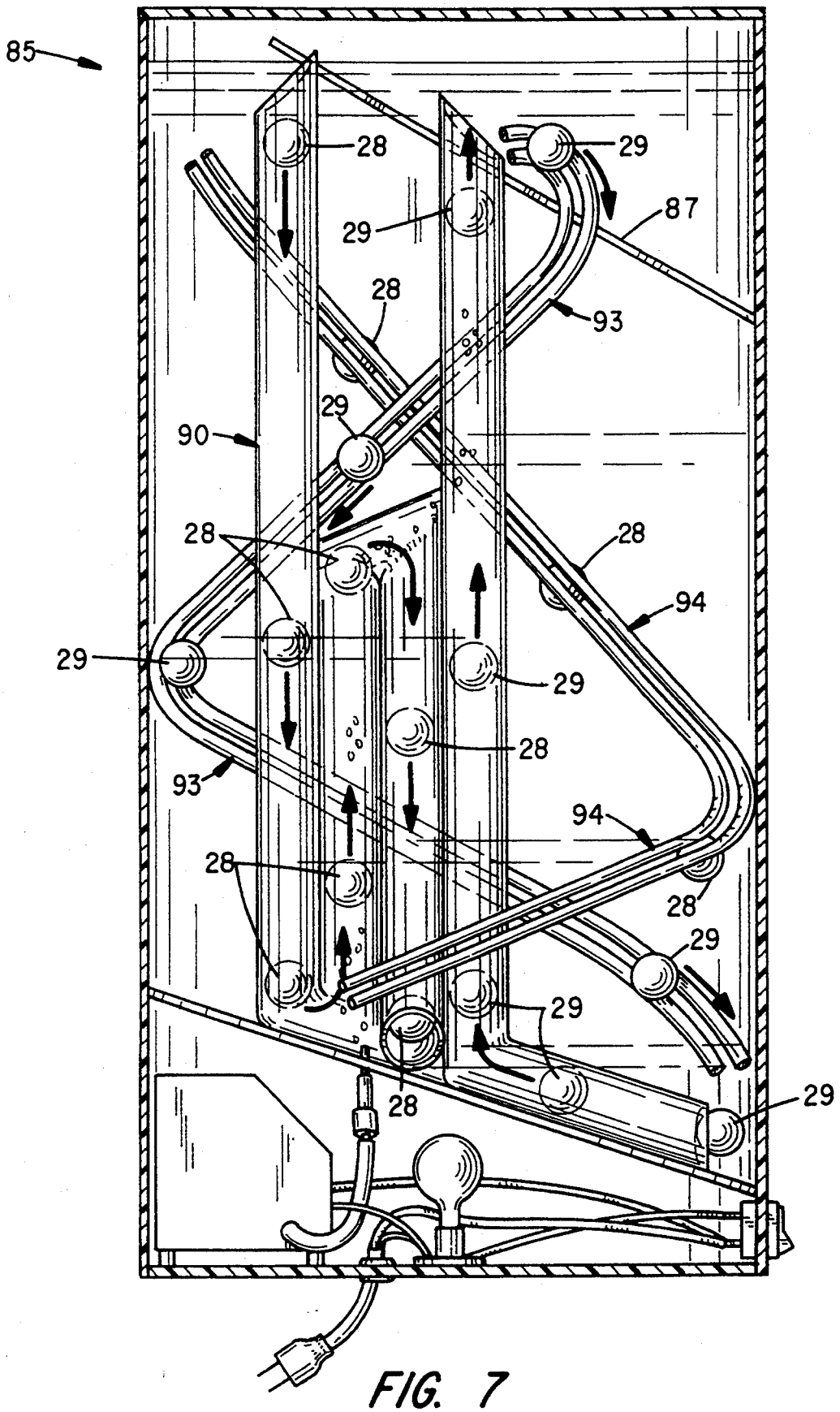
FIG. 7 is a side elevational view of another embodiment of the present invention having a cylindrical tank.
Figure 8:
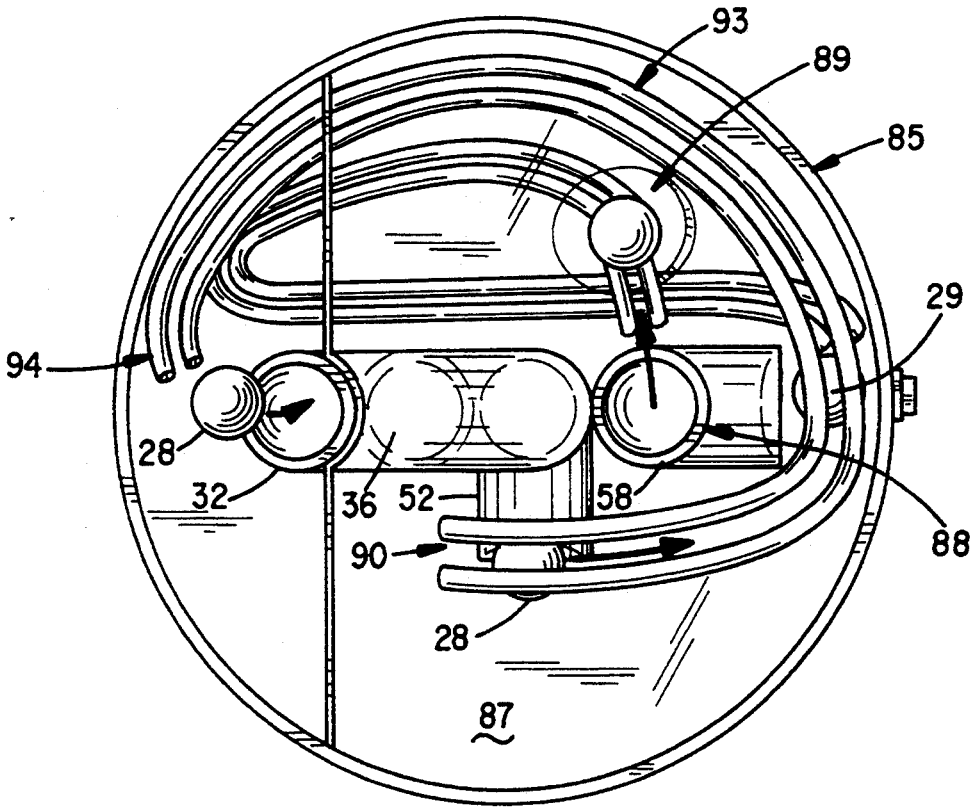
FIG. 8 is a top plan view of the embodiment shown in FIG. 7.

FIGS. 7 and 8 show an alternative embodiment of the invention comprised of a cylindrical tank 85 with the upper and downward tubal systems combined to form a cluster 90 of tubes 32, 36, 52, and 58. The upward and downward directional tracks 93 and 94 each comprising two adjacent round members 71, 72, are disposed in a circuitous manner along opposing sides of the inside surface of the tank 85 so that the positive buoyant spheres 28 move along a completely different path then the negative buoyant spheres 29.

Also shown in FIGS. 7 and 8 is an optional planar guide 87 used to direct or guide the positive buoyant spheres 28 to the top opening 34 on the long descending tube 32. The planar guide 87 is diagonally aligned near the top portion of the tank 10 and extends slightly above the top surface 16(*a*) of the liquid medium to that positive buoyant spheres 28 that escape from the long descending tube 32 or the track 54 are directed back to the staging area on the top surface 16(*a*). The planar guide 87 has two openings through which the upper portion of the long ascending tube 58 and the downward directing track 54 may extend.

In order to practice the invention, the size and buoyancies of the spheres 28, 29, the inside diameter of the tubes 32, 36, 52, 58, the slope of the upward and downward directional tracks 54, 63, and the amount of air pumped by the air pump 25 must be determined. In the preferred embodiment, the liquid medium 16 is clear or colored water which has a specific gravity of approximately 1.0. The relatively buoyancies of the positive and negative buoyant spheres 28, 29 must be suitable for the particular type of liquid medium 16 in order for the invention to operate properly. In the preferred embodiment, the positive and negative buoyant spheres 28, 29, respectively, are hollow and are made of plastic material. The negative buoyant spheres 29 are filled with a liquid fluid so that their specific gravity is between 1.03 and 1.08. The positive buoyant spheres 28 are filled with sufficient air 99, approximately half-full, so that their specific gravity is between 0.92–0.98. In other embodiments, the positive and negative buoyant spheres 28, 29 may be made of or filled with other material.

In order to create an adequate current in the tubal systems, a sufficient amount of air 99 must be supplied to the tube 36, 58 and a sufficient amount of space between the inside surface of the tube 32, 36, 52, 58 and the outer surface of the spheres 28, 29 must be provided. In the preferred embodiment, the air pump 16 must deliver 1,200 to 1,800 cc of air per minute. The relative size of the spheres 28 28, 29 and the tubes 32, 36, 52, and 58 must be sufficient so that there is $\frac{1}{8}$ to $\frac{1}{4}$ inch clearance between the outer surface of the spheres 28, 29 and the inside surface of the tubes 32, 36, 52, and 58. In the preferred embodiment, the spheres 28, 29 are approximately $\frac{5}{8}$ inch in diameter and the inside surface of the tubes 32, 36, 52, and 58 is approximately $\frac{7}{8}$ inch.

By adjusting the slope of the upward and downward directional tracks 54, 63, the rate of movement of the spheres 28, 29 thereon may be controlled. In the preferred embodiment, the slope of the tracks 54, 63 is approximately 42%. The actual slope of the tracks used depends on the buoyancies of the spheres 28, 29. For example, if the buoyancies are increased, the slopes of the tracks 54, 63 may be reduced. If the buoyancies are decreased, the slope of the tracks 54, 63 may be increased.

In compliance with the statute, the invention has been described in language more or less specific as to structural features. It should be understood, however, that the invention is not limited to the specific features shown since the means and construction shown comprises the preferred forms of putting the invention into effect. For example, the tank could be square or rectangular in cross-section or oil could be used in place of water as the liquid medium. The invention is, therefore, claimed in any of its forms or modifications within the legitimate and valid scope of the amended claims, appropriately interpreted in accordance with the doctrine of equivalents.

I claim:

1. An amusement liquid-tight device, comprising:

a. a tank, said tank being made of transparent material and having a floor;

b. a liquid medium placed inside said tank, said liquid medium having a top surface;

c. a plurality of positive buoyant spheres placed in said liquid medium, said positive buoyant spheres being capable of floating to said top surface of said liquid medium when placed therein;

d. a plurality of negative buoyant spheres placed in said liquid medium, said negative buoyant spheres being capable of sinking in said liquid medium to the floor of said tank when placed in said liquid medium;

e. a downward directing tubal system disposed vertically inside said tank, said downward directing tubal system having a top opening located near said top surface of said liquid medium and a bottom opening located near said floor of said tank, said downward directing tubal system including means to create a downward current therein thereby forcibly delivering said positive buoyant spheres floating near said top opening on said top surface of said liquid medium to said floor of said tank;

f. an upward directing tubal system disposed vertically inside said tank, said upward directing tubal system having a top opening located near said top surface of said liquid medium and a bottom opening located near said floor of said tank, said upward directing tubal system including means to create an upward current therein thereby forcibly delivering said negative buoyant spheres located near said bottom opening upward to said top surface of said liquid medium;

g. an upward directional track disposed inside said tank capable of directing said positive buoyant spheres delivered to said floor of said tank to said top surface of said liquid medium, and;

h. a downward directional track disposed inside said tank capable of directing said negative buoyant spheres delivered to said top surface of said liquid medium to said floor of said tank.

2. An amusement device, as recited in claim 1, wherein said downward directing tubal system includes a long descending tube, a short ascending tube, and a short descending tube joined together to form a continuous tube structure, said downward directing tubal system further including a first air source attached thereto capable of creating a downward current inside said long descending tube.

3. An amusement device, as recited in claim 2, wherein said upward directing tubal system includes a long ascending tube disposed vertically in said tank, said long ascending tube having a second air source attached thereto capable of creating an upward current inside said long ascending tube.

4. An amusement device, as recited in claim 3, wherein said first air source is attached to an air pump.

5. An amusement device, as recited in claim 4, wherein said second air source is a conduit disposed between said short ascending tube and said long ascending tube, said conduit being capable of delivering air from said short ascending tube to said long ascending tube.

6. An amusement device, as recited in claim 5, wherein said downward directional track and said upward directional track are aligned in a stacked position to form a dual directional track structure.

7. An amusement device, as recited in claim 6, wherein said downward directional track and said upward directional track comprise two tubes located side-by side with upper and lower valleys formed therebetween capable of retaining said positive and said negative buoyant spheres therein to form a dual directional track structure.

8. An amusement device, as recited in claim 6, wherein said downward directional track and said upward directional track comprise two tangentially aligned, semi-circular members capable of retaining said positive and said negative buoyant spheres therein to form a dual directional track structure.

9. An amusement device, as recited in claim 6, wherein said downward directional track and said upward directional track comprise a "Z" shaped member having an upper portion capable of retaining said negative buoyant spheres and a lower portion capable of retaining said positive buoyant spheres to form a dual directional track structure.

10. An amusement device, as recited in claim 3, further including a light source capable of illuminating said tank.

11. An amusement device, as recited in claim 3, wherein said tank is polygonal.

12. An amusement device, as recited in claim 3, wherein said tank is cylindrical.

13. An amusement device, as recited in claim 3, wherein said liquid medium is made of water.

14. An amusement device, as recited in claim 13, wherein said tank is polygonal.

15. An amusement device, as recited in claim 13, wherein said dual directional track comprises two tubes located side-by-side with upper and lower valleys formed therebetween capable of retaining said positive and said negative buoyant spheres therein.

16. An amusement device, as recited in claim 13, wherein said dual directional track comprises two tangentially aligned, semi-circular members capable of retaining said positive and said negative buoyant spheres therein.

17. An amusement device, as recited in claim 13, wherein said dual directional track comprises a "Z" shaped member having an upper portion capable of retaining said negative buoyant spheres and a lower portion capable of retaining said positive buoyant spheres.

18. An amusement device, as recited in claim 13, wherein said second air source is a conduit disposed between said short ascending tube and said long ascending tube, said conduit being capable of delivering air from said short ascending tube to said long ascending tube.

19. A amusement device, comprising:

a. a tank capable of holding a liquid medium, said tank being made of transparent material and having a floor;

b. a liquid medium placed inside said tank, said liquid medium having a top surface;

c. a plurality of positive buoyant spheres placed in said liquid medium, said positive buoyant spheres being capable of floating to said top surface of said liquid medium when placed therein;

d. a plurality of negative buoyant spheres placed in said liquid medium, said negative buoyant spheres being capable of sinking in said liquid medium to said floor of said tank when placed in said liquid medium;

e. a long descending tube disposed vertically inside said tank, said long descending tube having a top opening and being connected to a short ascending tube and a short descending tube to form a continuous tube structure, said short descending tube having a bottom opening located near said floor of said tank, said long descending tube, short ascending tube, and short descending tube having a sufficient diameter to enable said positive buoyant spheres to move continuously therethrough, f. a first air source attached to said short ascending tube capable of supplying a sufficient amount of air thereto to create a downward current inside said long descending tube to forcibly deliver said positive buoyant spheres to said floor of said tank;

g. a long ascending tube disposed vertically inside said tank, said long ascending tube having a top opening located near said top surface of said liquid medium and a bottom opening located near said floor of said tank, said long ascending tube having a sufficient diameter to enable said negative buoyant spheres to move longitudinally therein, h. a second air source attached to said long ascending tube capable of supplying a sufficient amount of air thereto to create an upward current therein sufficient to forcibly deliver said negative buoyant spheres to said top surface of said liquid medium, and;

i. a dual directional track disposed inside said tank capable of delivering said positive buoyant spheres delivered from the said floor of said tank to the said top surface of said liquid medium, said dual directional track also capable of delivering said negative buoyant spheres delivered from said top surface of said liquid medium to said floor of said tank.

20. An amusement device, as recited in claim 19 wherein said liquid medium is water.

* * * * *